US006451520B1

(12) United States Patent
Odenwälder et al.

(10) Patent No.: US 6,451,520 B1
(45) Date of Patent: Sep. 17, 2002

(54) COLOR PHOTOGRAPHIC SILVER HALIDE MATERIAL

(75) Inventors: Heinrich Odenwälder, Leverkusen; Hans Langen, Bonn; Uwe Dahlhaus, Burscheid, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/916,363

(22) Filed: Jul. 27, 2001

(30) Foreign Application Priority Data

Jul. 31, 2000 (DE) ..... 100 35 148
Apr. 9, 2001 (DE) ..... 101 17 672

(51) Int. Cl.[7] ..... G03C 1/08; G03C 7/26; G03C 7/32

(52) U.S. Cl. ..... 430/551; 430/607; 430/613; 430/599; 430/600; 430/555

(58) Field of Search ..... 430/551, 607, 430/613, 599, 600, 555

(56) References Cited

U.S. PATENT DOCUMENTS

| | | | | | |
|---|---|---|---|---|---|
| 4,705,747 | A | * | 11/1987 | Klotzer et al. | 430/569 |
| 5,120,637 | A | | 6/1992 | Furusawa et al. | 430/546 |
| 5,427,904 | A | * | 6/1995 | Borst et al. | 430/613 |
| 5,441,851 | A | * | 8/1995 | Singer et al. | 430/551 |
| 5,702,877 | A | * | 12/1997 | Odenwalder et al. | 430/551 |
| 5,719,019 | A | * | 2/1998 | Janusonis et al. | 430/613 |
| 5,804,364 | A | * | 9/1998 | Takehara | 430/613 |

* cited by examiner

*Primary Examiner*—Geraldine Letscher
(74) *Attorney, Agent, or Firm*—Connolly Bove Lodge & Hutz LLP

(57) ABSTRACT

A colour photographic silver halide material comprising a support and at least one silver halide emulsion layer which is deposited thereon and which contains at least one colour coupler, characterised in that said layer also contains a compound of formula (I)

(I)

wherein $R_1$ denotes alkyl, aryl, aralkyl or hetaryl, $R_2$ denotes H or $R_1$, or $R_1$ and $R_2$ together denote the remaining members of a heterocyclic ring, $R_3$, $R_4$, independently of each other, denote aryl or hetaryl or together denote the remaining members of a phenanthrene ring which is condensed-on in the 9,10-position, wherein $R_1$ can also be H if $R_3$ and $R_4$ together form a phenanthrene ring, is distinguished by improved granularity.

9 Claims, No Drawings

COLOR PHOTOGRAPHIC SILVER HALIDE MATERIAL

This invention relates to a colour photographic silver halide material which exhibits improved granularity.

Colour photographic materials, particularly colour films, should have a granularity which is as fine as possible. However, since they should also have a high sensitivity to light, and increasing their sensitivity to light usually results in the enlargement of the silver halide grains which in turn has an adverse effect on granularity, it is often impossible to produce fine-grained colour photographic materials of high sensitivity.

Attempts have been made to overcome this disadvantage by employing certain benz-imidazoles (DE 195 07 913); however, this has resulted in an increase in fogging. 1-dodecyl-2-methylimidazole (U.S. Pat. No. 4,585,728, compound No. 18) exhibits what are merely unsatisfactory values of granularity and sensitivity.

The object of the present invention was to improve granularity without loss of sensitivity and without an increase in fogging.

It has now surprisingly been found that this object can be achieved by the addition of certain imidazoles.

The present invention therefore relates to a colour photographic silver halide material comprising a support and at least one silver halide emulsion layer which is deposited thereon and which contains at least one colour coupler, characterised in that said layer also contains a compound of formula (I)

(I)

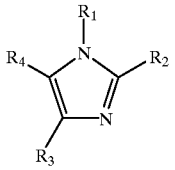

wherein $R_1$ denotes alkyl, aryl, aralkyl or hetaryl, $R_2$ denotes H or $R_1$, or $R_1$ and $R_2$ together denote the remaining members of a heterocyclic ring, $R_3$, $R_4$, independently of each other, denote aryl or hetaryl or together denote the remaining members of a phenanthrene ring which is condensed-on in the 9,10-position, wherein $R_1$ can also be H if $R_3$ and $R_4$ together form a phenanthrene ring.

The aforementioned substituents can be substituted by halogen, hydroxy, alkoxy, amino, acylamino, alkoxycarbonyl and aininosulphonyl; aryl can be substituted by aralkyl in the aryl part, and hetaryl can also be substituted by alkyl.

In particular, the compound of formula (I) is used in the respective layer in an amount ranging from 0.1 to 3.0 mol, preferably 0.5 to 1.2 mol/mol coupler.

The compound of formula (I) is preferably dissolved or dispersed, together with the colour coupler, in a high-boiling organic solvent; the solution or dispersion is then emulsified in an aqueous solution of a binder, usually in an aqueous solution of gelatine.

The compound of formula (I) is preferably used together with a 2-equivalent magenta coupler of the pyrazolone series, which has a molecular weight between 500 and 1500 and is used in an amount of 0.3 to 1.5 g/m$^2$.

Preferred pyrazolone couplers correspond to formula (II)

(II)

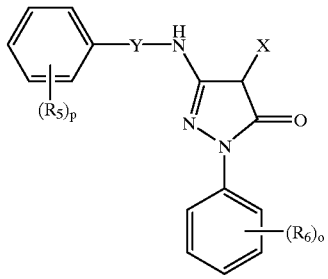

wherein $R_5$ denotes a substituent from the series comprising aryl, alkylsulphoxyl, aryl-sulphoxyl, acyl, halogen, acylamino, aminosulphonyl, alkylsulphonyl, aryl-sulphonyl, sulphonamido, imido, carbamato, heteroacylyl, alkylthio, carboxyl or hydroxyl, $R_6$ denotes a substituent from the group comprising halogen, CN, allylsulphonyl, arylsulphonyl, sulphamoyl, sulphamido, carbamoyl, carbonamido, alkoxy, acyl-oxyl, aryloxy, alkoxycarbonyl, ureido, nitro, alkyl, perchloryl and trifluoro-methyl, X denotes a cleavage group, Y denotes a direct bond or CO, and o and p denote 0 or a number from 1 to 5, wherein if o and/or p>1, the substituents $R_5$ and $R_6$ can be identical or different.

The preferred cleavage groups are halogen, alkoxy, aryloxy, alkylthio, arylthio, acyloxy, sulphonarnido, sulphonyloxy, carbonamido, arylazo, imido, heterocyclene radicals which contain nitrogen, and hetarylthio radicals.

Particularly preferred magenta couplers correspond to formula (III)

(III)

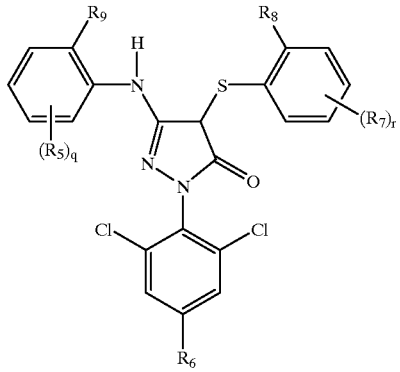

wherein $R_5$ and $R_6$ have the meanings given above, $R_7$ denotes hydrogen or an organic radical, $R_8$ denotes acylamino or sulphonylamino, $R_9$ denotes chlorine or a $C_1$–$C_4$ alkoxy group, and r and q, independently of each other, denote 0, 1 or 2.

Suitable couplers of formulae (II) and (III) include:
II-1
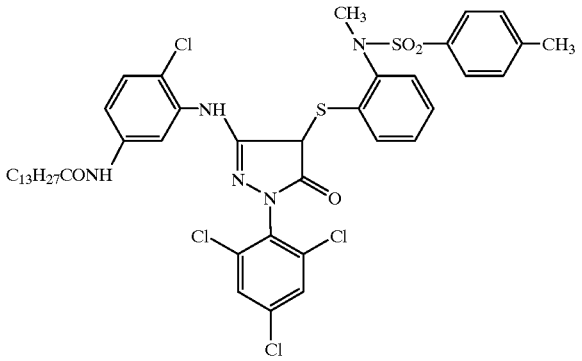
II-2
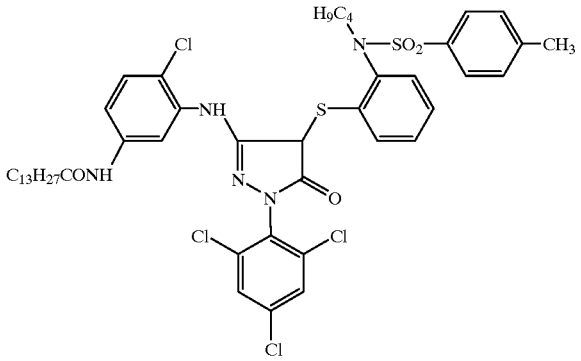
II-3
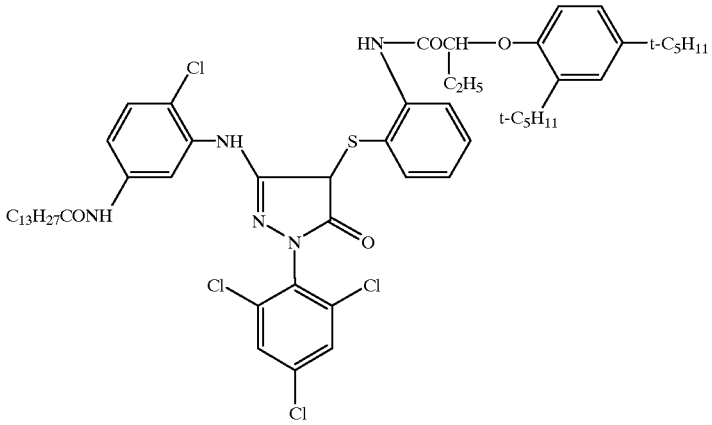
II-4
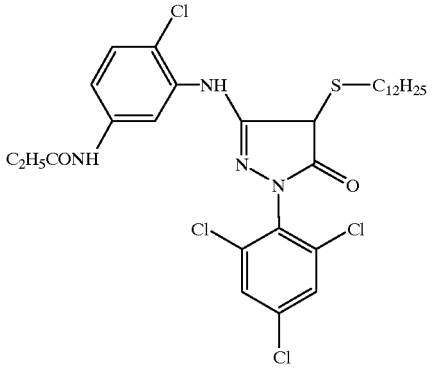
II-5
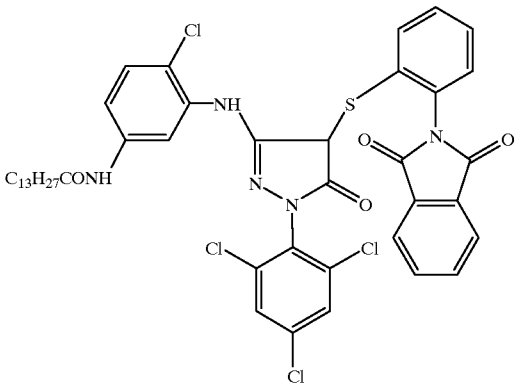
II-6
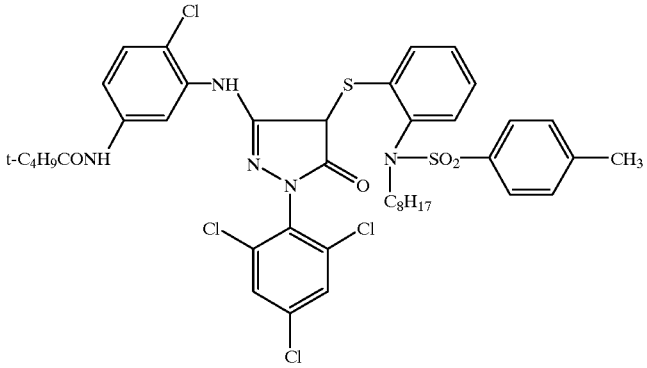

-continued
II-7
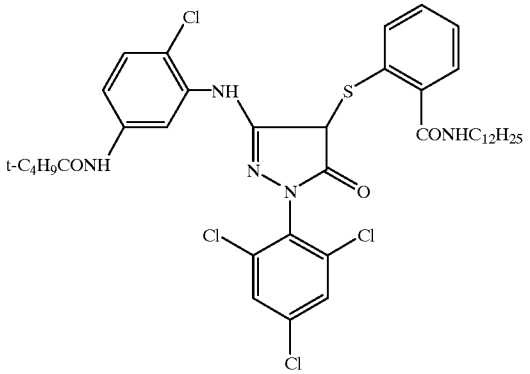
II-8
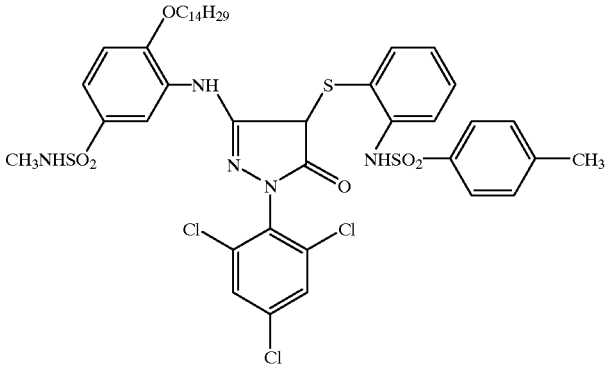
II-9
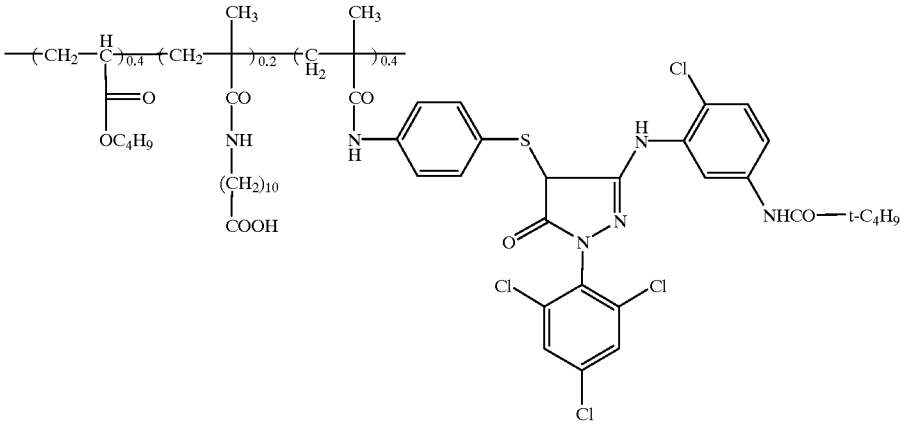
II-10
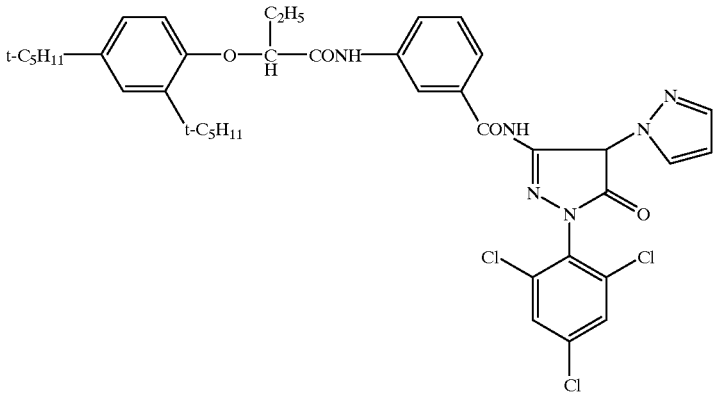

-continued

II-11

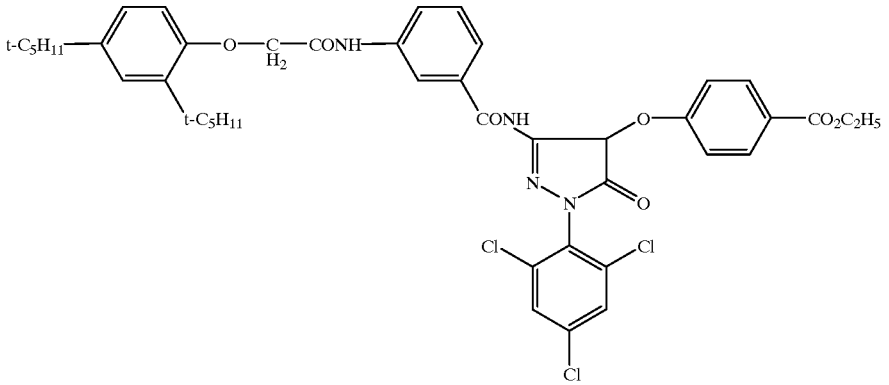

The compounds of formula I according to the invention can also be used in combination with yellow or cyan couplers and improve the sensitivity/granularity ratio there also.

The preferred compounds of formula (I) correspond to formulae (Ia) and (Ib) given below, wherein $R_1$ and $R_2$ have the meanings given above.

(Ia)

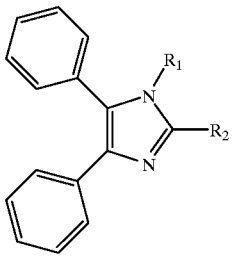

-continued (Ib)

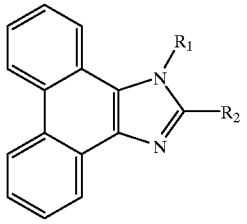

Suitable compounds of formula (Ia):

| No. | $R_1$ | $R_2$ |
|---|---|---|
| 1 | n-$C_6H_{13}$ | H |
| 2 | n-$C_{12}H_{25}$ | H |
| 3 | n-$C_{16}H_{33}$ | H |
| 4 | n-$C_{12}H_{25}$ | 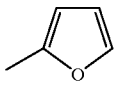 |
| 5 | —$(CH_2)_{11}$— | |
| 6 | —$(CH_2)_3$—O—$CH_2CH(C_2H_5)C_4H_9$ | H |
| 7 | —$CH_3$ | —S—$C_{12}H_{25}$ |
| 8 | —$C_{16}H_{33}$ | 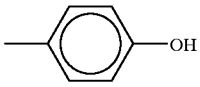 |
| 9 | n-$C_{12}H_{25}$ | 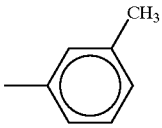 |

-continued

| No. | $R_1$ | $R_2$ |
|---|---|---|
| 10 | $-C_6H_4-SO_2NH_2$ | $-C_6H_4-OC_{16}H_{33}$ |
| 11 | $-isoC_{13}H_{27}$ | H |
| 12 | $-CH_2COO-CH(CH_3)-OO-C_{12}H_{25}$ | H |
| 13 | $-CH_2CH_2CN$ | $-C_6H_4-OC_{14}H_{29}$ |
| 14 | $-C_6H_4-SC_{12}H_{25}$ | H |
| 15 | $-C_6H_4-OC_{14}H_{29}$ | 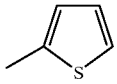 |
| 16 | $-nC_6H_{13}$ | H |
| 17 | $-nC_{12}H_{25}$ | 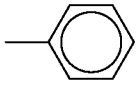 |
| 18 | $-C_6H_4-SC_{12}H_{25}$ | $-C_2H_5$ |
| 19 | $-C_6H_4-OH$ | $-C_6H_4-OC_8H_{17}$ |

Suitable compounds of formula (Ib):

| No. | $R_1$ | $R_2$ |
|---|---|---|
| 20 | H | $-C_6H_4-OC_{10}H_{21}$ |
| 21 | H | $-C_6H_4-OC_8H_{17}$ |
| 22 | H | $-C_6H_4-OC_{12}H_{25}$ |

-continued

| No. | $R_1$ | $R_2$ |
|---|---|---|
| 23 | H | 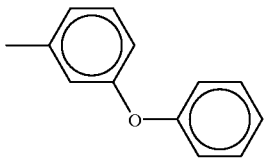 |
| 24 | H | $-nC_{10}H_{23}$ |
| 25 | $n-C_6H_{13}$ | H |

The compounds according to the invention can be prepared by methods which are generally known. For example, they can be prepared as shown in Scheme 1 by the alkylation of a protic imidazole, or can be prepared in a particularly simple manner as shown in Scheme 2 by a multi-component reaction in which unsubstituted to tetra substituted imidazoles are obtained directly.

Scheme 1

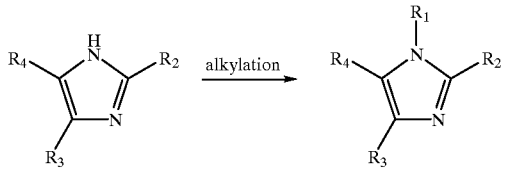

Scheme 2

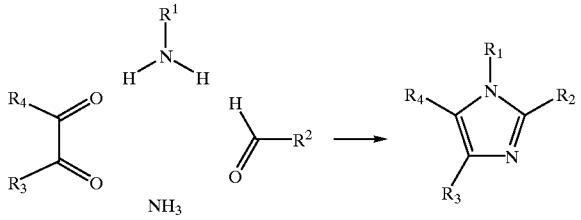

Synthesis of Compound 3

A mixture of 212 g benzil, 268 g hexadecylamine, 25 g hexamethylenetetramine and 155 g ammonium acetate was stirred at 80° C. for 4 hours in 500 ml glacial acetic acid. After cooling to room temperature, 1000 ml water and 1000 ml methanol were added and the batch was stirred for 2 hours.

The precipitate was filtered off and was washed successively with 2000 ml of a mixture of methanol/water (1:1), and then with 1500 ml methanol. Thereafter, the precipitate was stirred with 3000 ml methanol, filtered off and washed with 1500 ml methanol.

After drying, 309 g (69.5% theoretical) of compound 3 were obtained.

Examples of colour photographic materials include colour negative films, colour reversal films, colour positive films, colour photographic paper, colour reversal photographic paper, and colour-sensitive materials for the colour diffusion transfer process or the silver halide bleaching process.

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part M (1996), page 624.

Colour photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer. The yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, the silver halide grains and colour couplers.

Information on suitable binders is given in Research Disclosure 37254, Part 2 (1995), page 286, and in Research Disclosure 38957, Part IIa (1996), page 598.

Information on suitable silver halide emulsions, their production, ripening, stabilisation and spectral sensitisation, including suitable spectral sensitisers is given in Research Disclosure 37254, Part 3 (1995), page 286, in Research Disclosure 37038, Part XV (1995), page 89, and in Research Disclosure 38957, Part VA (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part XB (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XV (1995), page 86, and in Research Disclosure 38957, Part XC (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part XD (1996), page 621 et seq.

The photographic material may additionally contain compounds which absorb UV light, brighteners, spacers, filter dyes, formalin scavengers, light stabilisers, anti-oxidants, $D_{Min}$ dyes, plasticisers (latices), biocides, additives for improving the dye-, coupler- and white stability and to reduce colour fogging and yellowing, and other substances. Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part IIB (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), together with examples of materials.

EXAMPLE 1 (comparison)

A colour photographic recording material for colour negative development was produced (layer structure 1A) by depositing the following layers in the given sequence on a transparent film base comprising polyethylene glycol 2,6-naphthalate with a magnetic layer on the back. The quantitative data are given with respect to 1 $m^2$ in each case. The corresponding amounts of $AgNO_3$ are quoted for silver halide deposition. The silver halides were stabilised with 0.5 g 4-hydroxy-6-methyl-1,3,3a,7-tetraazaindene per mol $AgNO_3$.

1st layer (anti-halo layer)

0.3 g black colloidal silver 1.2 g gelatine 0.3 g V absorber UV 1

0.2 g DOP (developer oxidation product)—scavenger SC-1

0.02 g tricresyl phosphate (TCP)

2nd layer (low red-sensitivity layer)

0.7 g $AgNO_3$ of an AgBrI emulsion, spectrally sensitised to red, 4 mol-% iodide, average grain diameter 0.42 μm, 1 g gelatine 0.35 g colourless coupler C-1

0.05 g coloured coupler RC-1

0.03 g coloured coupler YC-1

0.36 g TCP

3rd layer (medium red-sensitivity layer)

0.8 g $AgNO_3$ of an AgBrI emulsion, spectrally sensitised to red, 5 mol-% iodide, average grain diameter 0.53 μm, 0.6 g gelatine 0.15 g colourless coupler C-2

0.03 g coloured coupler RC-1

0.02 g DIR coupler D-1

0.18 gTCP

4th layer (high red-sensitivity layer)

| | |
|---|---|
| 1 g | $AgNO_3$ of an AgBrI emulsion, spectrally sensitised to red, 6 mol-% iodide, average grain diameter 0.85 μm, |
| 1 g | gelatine |
| 0.1 g | colourless coupler C 2 |
| 0.005 g | DIR coupler D 2 |
| 0.11 g | TCP |

5th layer (intermediate layer)

0.8 g gelatine 0.07 g DOP-scavenger SC-2.

0.06 g aluminium salt of aurinetricarboxylic acid

6th layer (low green-sensitivity layer)

| | |
|---|---|
| 0.7 g | $AgNO_3$ of an AgBrI emulsion, spectrally sensitised to green 4 mol-% iodide, average grain diameter 0.35 μm, |
| 0.8 g | gelatine |
| 0.36 mmol | colourless coupler II-1 |
| 0.065 g | coloured coupler YM-1 |
| 0.02 g | DIR coupler D-3 |
| 0.2 g | TCP |

7th layer (medium green-sensitivity layer)

| | |
|---|---|
| 0.9 g | $AgNO_3$ of an AgBrI emulsion, spectrally sensitised to green, 4 mol-% iodide, average grain diameter 0.50 μm, |
| 1 g | gelatine |
| 0.26 mmol | colourless coupler II-1 |
| 0.04 g | coloured coupler YM-1 |
| 0.015 g | DIR coupler D-4 |
| 0.14 g | TCP |

8th layer (high green-sensitivity layer)

| | |
|---|---|
| 0.6 g | $AgNO_3$ of an AgBrI emulsion, spectrally sensitised to green, 6 mol-% iodide, average grain diameter 0.70 μm, |
| 1.1 g | gelatine |
| 0.13 mmol | colourless coupler II-1 |
| 0.01 g | coloured coupler YM-2 |
| 0.02 g | DIR coupler D-5 |
| 0.08 g | TCP |

9th layer (yellow filter layer)

| | |
|---|---|
| 0.09 g | yellow dye Y-F1 |
| 1 g | gelatine |

-continued

| | |
|---|---|
| 0.08 g | DOP scavenger SC-2 |
| 0.26 g | TCP |

10th layer (low blue-sensitivity layer)

| | |
|---|---|
| 0.3 g | $AgNO_3$ of an AgBrI emulsion, spectrally sensitised to blue, 6 mol-% iodide, average grain diameter 0.44 μm, |
| 0.5 g | $AgNO_3$ of an AgBrI emulsion, spectrally sensitised to blue, 6 mol-% iodide, average grain diameter 0.50 μm, |
| 1.9 g | gelatine |
| 1.45 g | colourless coupler Y-1 |
| 0.037 g | DIR coupler D-6 |
| 0.6 g | TCP |

11th layer (high blue-sensitivity layer)

| | |
|---|---|
| 0.6 g | $AgNO_3$ of an AgBrI emulsion, spectrally sensitised to blue, 7 mol-% iodide, average grain diameter 95 μm, |

-continued

| | |
|---|---|
| 1.2 g | gelatine |
| 0.15 g | colourless coupler Y-1 |
| 0.006 g | DIR coupler D-7 |
| 0.11 g | TCP |

12th layer (micrate layer)

| | |
|---|---|
| 0.1 g | $AgNO_3$ of a micrate-AgBrI emulsion, 0.5 mol-% iodide, average grain diameter 0.06 μm, |
| 1 g | gelatine |
| 0.004 mg | $K_2[PdCl_4]$ |
| 0.4 g | UV absorber UV 2 |
| 0.3 g | TCP |

13th layer (protective and hardener layer)

0.25 g gelatins 0.75 g hardener H-1

After hardening, the overall layer structure had a swelling factor ≦3.2.

UV-1

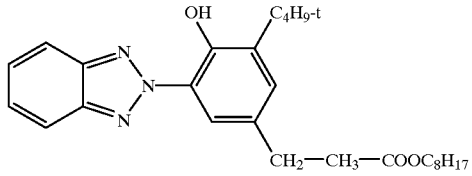

UV-2

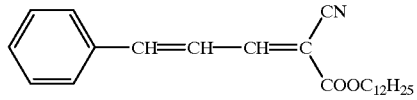

C-1

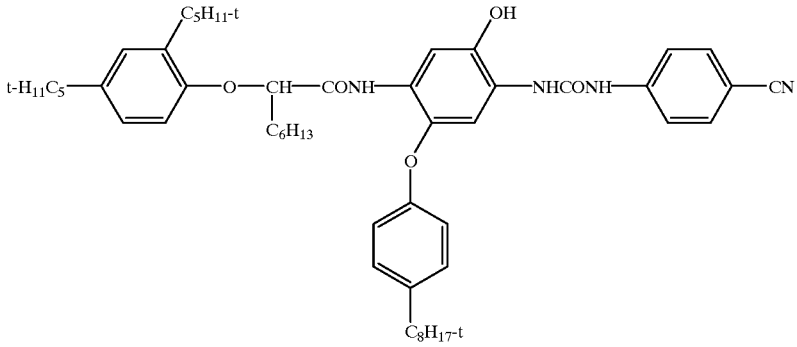

C-2

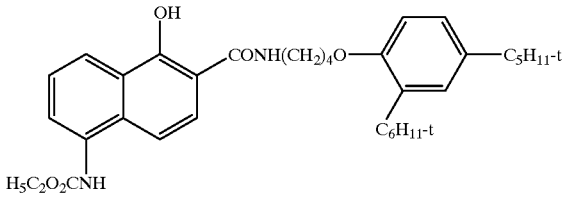

-continued
RC-1
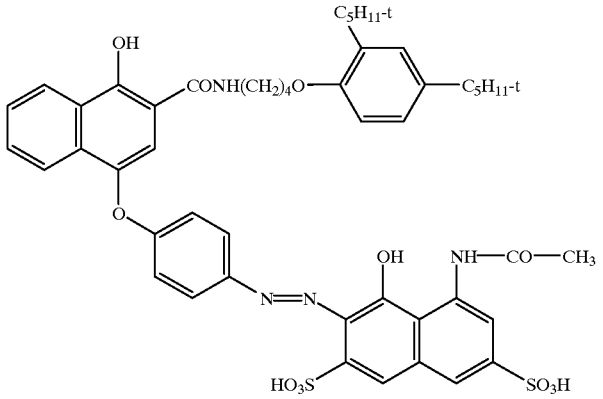
YC-1
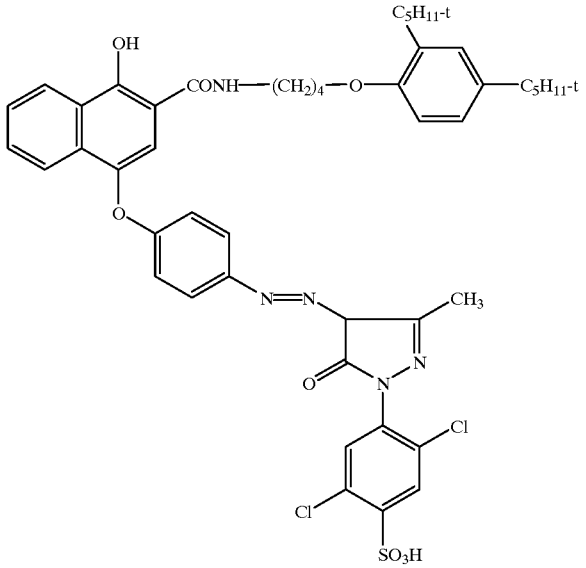
YM-1
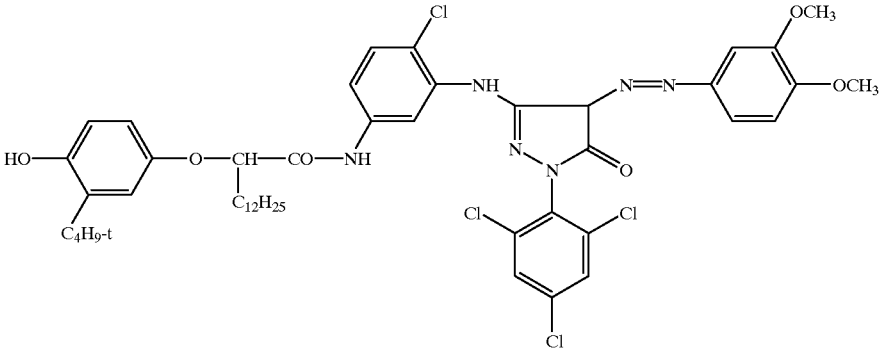
YM-2
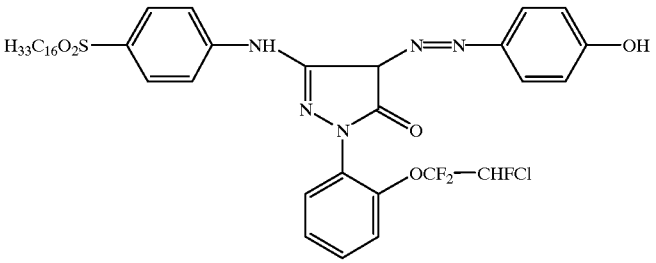

-continued
Y-F1
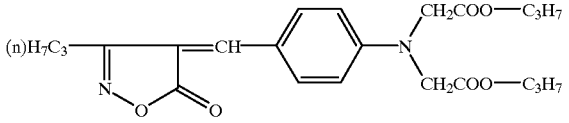
Y-1
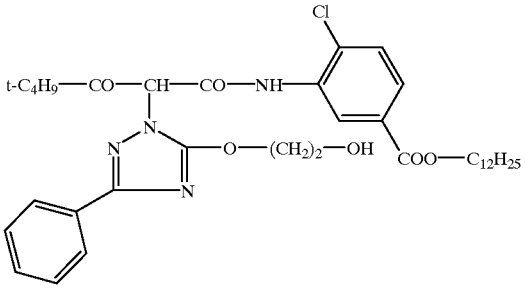
D-1
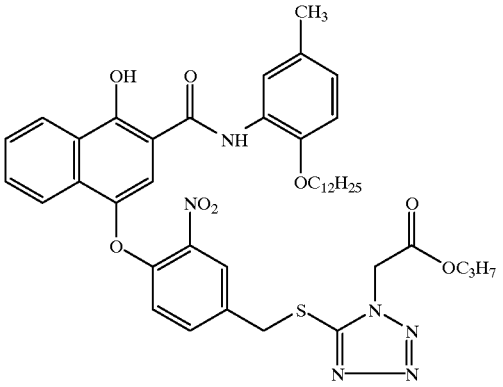
D-2
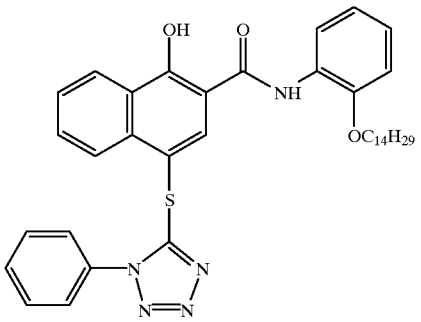
D-3
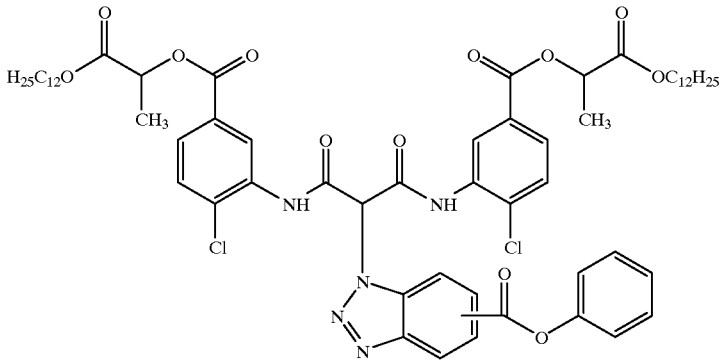

-continued
D-4
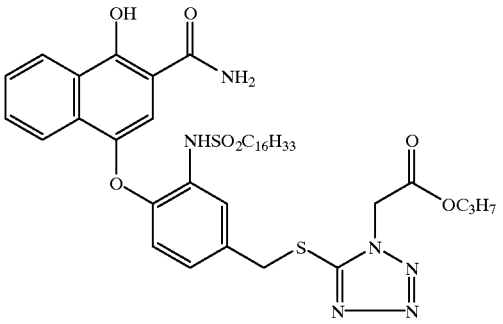
D-5
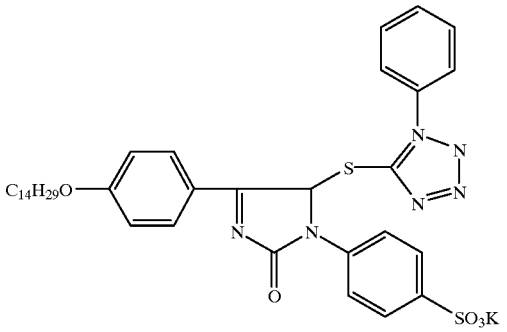
D-6
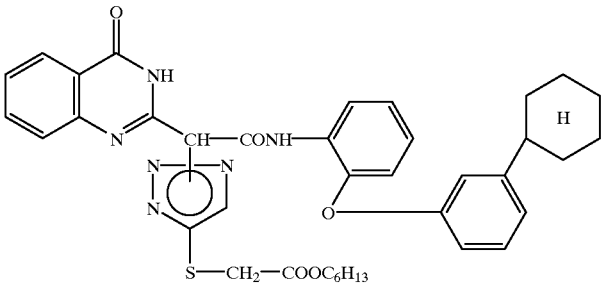
D-7
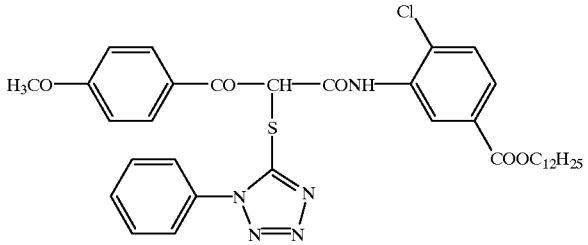
SC-1
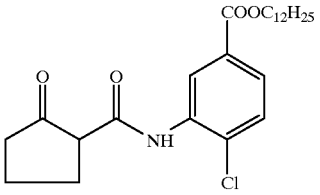

-continued

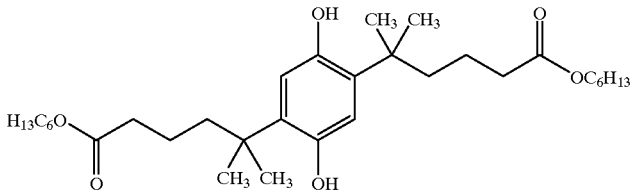

SC-2

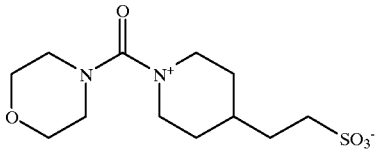

H-1

Examples 1.2–1.8 differ from Example 1.1 in that the magenta couplers given in Table 1 and the additives according to the invention were used in the 6th, 7th and 8th layers instead of magenta coupler I-1. For comparison, compound No. 18, which is known from U.S. Pat. No. 4,585,728 and which is similar to the claimed compounds, was used in Test 1.5.

Comparison compound A: No. 18 from U.S. Pat. No. 4,585,728

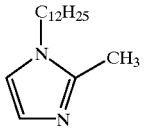

It can be seen from Table 1 that the combinations according to the invention exhibit considerable granularity advantages, even at higher sensitivities, compared with the examples which are not according to the invention. Table 2 shows that the examples according to the invention give rise to less fogging (when fresh). The difference between fogging (fresh) and fogging after storage is another advantage of the examples according to the invention.

TABLE 1

| No. | Colour coupler | Addition compound | Log H rel. (green) | Colour granularity RMS D = 0.2 | D = 0.5 | D = 1.0 | Status |
|---|---|---|---|---|---|---|---|
| 1.1 | II-1 | none | 100 | 14.8 | 12.5 | 11.2 | comparison |
| 1.2 | II-1 | I.2 | 109 | 12.2 | 11.1 | 10.4 | invention |
| 1.3 | II-2 | none | 100 | 14.7 | 12.4 | 11.1 | comparison |
| 1.4 | II-2 | I.9 | 115 | 12.2 | 11.0 | 10.5 | invention |
| 1.5 | II-2 | A | 98 | 14.7 | 12.4 | 11.3 | comparison |
| 1.6 | II-2 | I.4 | 117 | 12.1 | 11.1 | 10.3 | invention |
| 1.7 | II-5 | none | 100 | 14.9 | 12.5 | 11.2 | comparison |
| 1.8 | II-5 | I.23 | 105 | 12.1 | 11.2 | 10.3 | invention |

TABLE 2

| No. | Fresh fogging | Difference between fresh fogging and fogging after storage for 6 months at 35° C./80% r.h. |
|---|---|---|
| 1.1 | 0.63 | 0.12 |
| 1.2 | 0.57 | 0.03 |
| 1.3 | 0.61 | 0.11 |
| 1.4 | 0.55 | 0.03 |
| 1.5 | 0.63 | 0.12 |
| 1.6 | 0.57 | 0.04 |
| 1.7 | 0.64 | 0.13 |
| 1.8 | 0.58 | 0.05 |

What is claimed is:

1. A color photographic silver halide material comprising a support and at least one silver halide emulsion layer which is deposited thereon and which contains at least one color coupler, and said layer also contains a compound of formula (I)

(I)

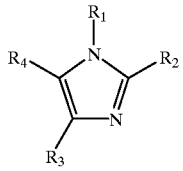

wherein $R_1$ is alkyl, aryl, aralkyl or hetaryl, $R_2$ is H or $R_1$, or $R_1$ and $R_2$ together denote the remaining members of a heterocyclic ring, $R_3$ and $R_4$, independently of each other, are aryl or hetaryl or together are the remaining members of a phenanthrene ring which is condensed-on in the 9,10-position, and wherein $R_1$ can also be H if $R_3$ and $R_4$ together form a phenanthrene ring.

2. The color photographic silver halide material according to claim 1, wherein the compound of formula (I) is in an amount of 0.1 to 3.0 mol/mol coupler.

3. The color photographic silver halide material according to claim 1, wherein the coupler is a 2-equivalent pyrazolone magenta coupler has a molecular weight between 500 and 1500 and is used in an amount ranging from 0.3 to 1.5 g/m$^2$.

4. The color photographic silver halide material according to claim 3, wherein the 2-equivalent magenta coupler corresponds to formula (II)

(II)

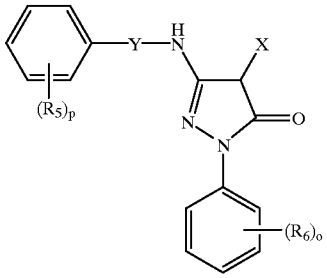

wherein $R^5$ is aryl, alkylsulphoxyl, arylsulphoxyl, acyl, halogen, acylamino, aminosulphonyl, alkylsulphonyl, arylsulphonyl, sulphonamido, imido, carbamato, heteroacylyl, alkylthio, carboxyl or hydroxyl, $R^6$ is halogen, CN, alkylsulphonyl, arylsulphonyl, sulphamoyl, sulphamido, carbamoyl, carbonamido, alkoxy, acyloxyl, aryloxy, alkoxycarbonyl, ureido, nitro, alkyl, perchloryl or trifluoromethyl, X is a cleavage group, Y is a direct bond or CO, and o and p denote 0 or a number from 1 to 5, wherein if o and/or p >1, the substituents $R_5$ and $R_6$ can be identical or different.

5. The color photographic silver halide material according to claim 4, wherein the 2-equivalent magenta coupler corresponds to formula (III)

(III)

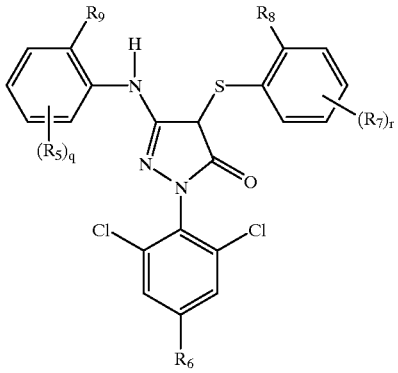

wherein $R_5$ is aryl, alkylsulphoxyl, arylsulphoxyl, acyl, halogen, acylamino, aminosulphonyl, alkylsulphonyl, arylsulphonyl, sulphonamido, imido, carbamato, heteroacylyl, alkylthio, carboxyl or hydroxyl, $R_6$ is halogen, CN, alkylsulphonyl, arylsulphonyl, sulphamoyl, sulphamido, carbamoyl, carbonamido, alkoxy, acyloxyl, aryloxy, alkoxycarbonyl, ureido, nitro, alkyl, perchloryl or trifluoromethyl, $R_7$ is hydrogen or an organic radical, $R_8$ is acylamino or sulphonylamino, $R_9$ is chlorine or a $C_1$–$C_4$ alkoxy group, and r and q, independently of each other, are 0, 1 or 2.

6. The color photographic silver halide material according to claim 1, wherein the compound of formula (I) corresponds to one of formulae (Ia) or (Ib)

(Ia)

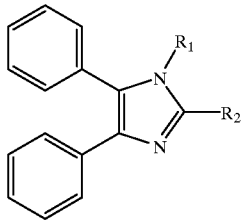

(Ib)

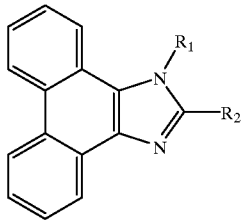

wherein $R_1$ is alkyl, aryl, aralkyl or hetaryl, $R_2$ is H or $R_1$, or $R_1$ and $R_2$ together are the remaining members of a heterocyclic ring.

7. The color photographic silver halide material according to claim 2, wherein the compound of formula (I) is in an amount of 0.5 to 1.2 mol/mol coupler.

8. The color photographic silver halide material according to claim 7, wherein the coupler is a 2-equivalent pyrazolone magenta coupler has a molecular weight between 500 and 1500 and is used in an amount ranging from 0.3 to 1.5 g/m$^2$.

9. The color photographic silver halide material according to claim 8, wherein the 2-equivalent magenta coupler corresponds to formula (III)

(III)

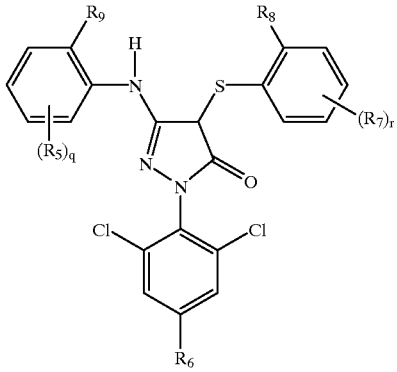

wherein $R_5$ is aryl, alkylsulphoxyl, arylsulphoxyl, acyl, halogen, acylamino, aminosulphonyl, alkylsulphonyl, arylsulphonyl, sulphonamido, inido, carbamato, heteroacylyl, alkylthio, carboxyl or hydroxyl, $R_6$ is halogen, CN, alkylsulphonyl, arylsulphonyl, sulphamoyl, sulphamido, carbamoyl, carbonamido, alkoxy, acyloxyl, aryloxy, alkoxycarbonyl, ureido, nitro, alkyl, perchloryl or trifluoromethyl, $R_7$ is hydrogen or an organic radical, $R_8$ is acylamino or sulphonylamino, $R_9$ is chlorine or a $C_1$–$C_4$ alkoxy group, and r and q, independently of each other, are 0, 1 or 2.

* * * * *

UNITED STATES PATENT AND TRADEMARK OFFICE

CERTIFICATE OF CORRECTION

PATENT NO. : 6,451,520 B1
DATED : September 17, 2002
INVENTOR(S) : Odenwälder et al.

It is certified that error appears in the above-identified patent and that said Letters Patent is hereby corrected as shown below:

Column 26,
Line 66, delete “inido” and insert -- imido --.

Signed and Sealed this

Thirty-first Day of December, 2002

JAMES E. ROGAN
*Director of the United States Patent and Trademark Office*